US006116555A

United States Patent [19]

Claus et al.

[11] Patent Number: 6,116,555

[45] Date of Patent: Sep. 12, 2000

[54] PLASTIC CHAIR BASE INCLUDING HUB WITH INTEGRAL RING AND OPPOSITELY-DIRECTED TAPERS

[75] Inventors: Robert J. Claus; Yun Feng, both of Green Bay, Wis.

[73] Assignee: Krueger International, Inc., Green Bay, Wis.

[21] Appl. No.: 09/086,915

[22] Filed: May 29, 1998

[51] Int. Cl.[7] ..... A47B 91/00

[52] U.S. Cl. ..... 248/188.7; 248/161; 248/519

[58] Field of Search ..... 248/519, 161, 248/404, 188.7

[56] References Cited

U.S. PATENT DOCUMENTS

| | | | |
|---|---|---|---|
| 1,392,120 | 9/1921 | Cooper | 248/519 X |
| 3,719,340 | 3/1973 | Norton | 248/188.7 X |
| 4,899,969 | 2/1990 | Bauer et al. | 248/161 |
| 5,149,035 | 9/1992 | Bonnema et al. . | |
| 5,284,312 | 2/1994 | Dony | 248/161 |
| 5,366,275 | 11/1994 | Sulzer | 248/161 X |
| 5,377,943 | 1/1995 | Perl . | |
| 5,402,973 | 4/1995 | Haines . | |
| 5,433,409 | 7/1995 | Knopp . | |
| 5,454,536 | 10/1995 | Melhuish . | |
| 5,462,248 | 10/1995 | Bauer | 248/161 |
| 5,501,419 | 3/1996 | Huang . | |
| 5,692,715 | 12/1997 | Hertel . | |
| 5,740,997 | 4/1998 | Van Wieran | 248/161 X |
| 5,791,611 | 8/1998 | Battey et al. | 248/519 X |

*Primary Examiner*—Leslie A. Braun
*Assistant Examiner*—Gwendolyn Baxter
*Attorney, Agent, or Firm*—Andrus, Sceales, Starke & Sawall

[57] ABSTRACT

A hub is provided for the base of a swivel-type chair in which the hub includes a passage forming an interior wall which receives and retains therein a gas cylinder joining the base with a seat of the chair. The interior wall of the hub is formed with an upper portion, a ring portion, and a lower portion. The upper portion slopes downwardly and inwardly at a first taper angle relative to a longitudinal axis of the gas cylinder and the passage. The ring portion has an upper segment sloping downwardly and inwardly from the upper portion at a second taper angle greater than the first taper angle, a medial segment extending vertically from the upper segment, and a lower segment sloping downwardly and outwardly from the medial segment at a third taper angle less than the second taper angle but greater than the first taper angle. The lower portion slopes downwardly and outwardly from the lower segment of the ring portion at a fourth taper angle relative to the longitudinal axis of the gas cylinder and the passage and slightly greater than the first taper angle. The upper portion cooperates with a first similarly-shaped portion of the gas cylinder to prevent wobbling of the cylinder relative to the base. The upper segment of the ring portion engages a second similarly-shaped portion of the gas cylinder to preclude longitudinal movement of the cylinder relative to the base.

16 Claims, 2 Drawing Sheets

PLASTIC CHAIR BASE INCLUDING HUB WITH INTEGRAL RING AND OPPOSITELY-DIRECTED TAPERS

FIELD OF THE INVENTION

The present invention relates broadly to bases for swivel-type chairs and, more particularly, pertains to a specially formed hub for properly supporting a cylinder used to permit rotation and height variance of a chair seat relative to the base.

BACKGROUND AND SUMMARY OF THE INVENTION

Chairs of the type provided with swiveling seats and supporting bases with integral central hubs of plastic construction are well-known in the art. Such swivel-type chairs generally include a central column preferably in the form of a gas, pneumatic or hydraulic cylinder between a seat of the chair and the base, permitting the seat to rotate and slide up or down along the longitudinal axis of the column as desired. In the past, chair bases have been formed of a welded metal subassembly including a central hub and a series of arms extending outwardly from the hub. The central column is mounted to the hub and casters are secured to each arm adjacent its outer end. A molded plastic shroud is engaged over the hub and arms to conceal the welded subassembly and enhance the aesthetic appearance of the base. Alternatively, the hub and arms may be formed of molded plastic, and a metallic insert positioned in a central throughbore of the hub. In either construction, a generally satisfactory seat was created so as to prevent wobbling or lateral deflection of the column relative to the base. However, because of problems in methods of manufacturing and holding manufacturing tolerances, there may not always be a snug fit between the metal column and the metal hub or insert, such that wobbling of these components will eventually occur, thereby resulting in undesirable and unacceptable rocking of the chair. Further, the need for the metal insert or welded metal subassembly adds to the overall cost of components and assembly of the base.

U.S. Pat. No. 5,377,943 issued to Perl on Jan. 3, 1995 shows a one-piece molded chair base in which the taper on the hub is removed and replaced with an internal step extending generally perpendicularly to upper and lower portions of the hub for engaging the bottom end of the column when the column is inserted into the throughbore of the hub. A further plastic molded base design is disclosed in U.S. Pat. No. 5,692,715 issued to Hertel on Dec. 2, 1997 which sets forth a dual tapered locking hub. A first tapered portion having a first taper angle is provided for a major portion in the length of the hub, and a second tapered portion having a second taper angle is provided in the remainder of the hub. The first taper angle on the hub cooperates with a similar tapered surface on the column to prevent wobbling of the column and the base. The second taper angle of the hub is greater than the first taper angle so as to lock the column in the hub and prevent creeping.

Notwithstanding the prior art, it remains desirable to provide a plastic molded base having an integral hub construction which not only prevents wobbling and creeping of the column relative to the base, but enables an economical and easily performed molding of the hub in the base. The present invention allows these advantages by providing positive seating between a column and a hub specially formed with differently tapered portions above and below a ring portion.

It is one object of the present invention to provide a chair base in which a gas cylinder is suitably mounted in a hub integral with the base and is supported so as to transfer its load onto the hub with the hub stabilizing the gas cylinder from wobbling relative to the base. It is also an object of the present invention to provide a molded chair base having an integral hub which allows ease of molding yet provides a combination of tapered and ring-shaped bearing surfaces to hold a gas cylinder steady in a throughbore of the hub. It is a further object of the present invention to provide a chair base hub having a throughbore defining an interior wall formed with an upper tapered portion for stabilizing a gas cylinder against lateral deflection and a ring portion for preventing the gas cylinder from moving downwardly relative to the base.

The invention contemplates a base for a swivel-type chair wherein the base includes a set of arms and a central hub for mounting and maintaining therein a central column joining the base with a seat of the chair. The hub is formed with a passage extending along a longitudinal axis coincident with a longitudinal axis of the central column. The passage defines a first wall portion tapered downwardly and inwardly relative to the longitudinal axis of the passage, and a second wall portion tapered downwardly and outwardly relative to the longitudinal axis of the passage. The central column is received within the passage and engages the first wall portion, and is thereby prevented from moving laterally and downwardly relative to the base. The hub further includes a ring portion projecting inwardly relative to the longitudinal axis of the passage and interconnecting the first wall portion and the second wall portion. The ring portion has an upper segment sloping downwardly and inwardly from the first wall portion, a medial segment extending vertically from the upper segment, and a lower segment sloping downwardly and outwardly from the medial segment. The central column includes an annular offset portion against which the upper segment of the ring portion is press fitted. The ring portion of the hub and the annular offset portion of the central column are located adjacent a bottom end of the arms. The first wall portion is located above the second wall portion, with the cross sectional area of the second wall portion being larger than the cross sectional area of the first wall portion. The second wall portion and the lower segment of the ring portion are spaced from the central column. The first wall portion has a length which is longer than the length of the second wall portion, while the second wall portion has a length which is longer than the length of the ring portion.

The invention further contemplates a chair base for a swivel-type chair wherein the base includes a central hub including a passage for receiving and engaging therein a central column of generally circular cross section joining the base with a seat of the chair. The invention contemplates the hub being provided with a primary bearing surface in the form of a major tapered wall portion sloping downwardly and inwardly at a first taper angle relative to the longitudinal axis of the passage, and a ring portion having at least a secondary bearing surface sloping downwardly and inwardly from the major tapered wall portion at a second taper angle greater than the first taper angle. With this construction, the major tapered wall portion prevents the central column from wobbling, and the secondary bearing surface prevents the central column from creeping through the base. The ring portion includes a tertiary bearing surface extending substantially vertically downwardly from the secondary bearing surface for further stabilizing the central column against wobbling, and a non-bearing surface extending downwardly and outwardly from the tertiary bearing surface. The passage includes a minor tapered wall portion sloping downwardly and outwardly from the non-bearing surface on the ring portion. The central column includes an upper portion shaped similarly to the major tapered wall portion of the hub, an angularly offset portion shaped similarly to the secondary bearing surface on the ring portion, and a lower, generally cylindrical portion formed with a diameter less than the diameter of the upper portion of the central column and spaced from the non-bearing surface and the minor tapered wall portion.

The invention also relates to a hub for the base of a swivel-type chair in which the hub includes a throughbore forming an interior wall which receives and retains therein a gas cylinder joining the throughbore with a seat of a chair. The interior wall of the hub is formed with an upper portion, a ring portion, and a lower portion. The upper portion slopes downwardly and inwardly at a first taper angle relative to a longitudinal axis of the gas cylinder and the throughbore. The ring portion has an upper segment sloping downwardly and inwardly from the upper portion at a second taper angle greater than the first taper angle, a medial segment extending vertically from the upper segment, and a lower segment sloping downwardly and outwardly from the medial segment at a third taper angle less than the second taper angle but greater than the first taper angle. The lower portion slopes downwardly and outwardly from the lower segment of the ring portion at a fourth taper angle relative to the longitudinal axis of the gas cylinder and the throughbore, which is slightly greater than the first taper angle. The upper portion cooperates with a first similarly-shaped portion of the gas cylinder to prevent wobbling of the cylinder relative to the base. The upper segment of the ring portion engages a second similarly-shaped portion of the gas cylinder to preclude longitudinal movement of the cylinder relative to the base. In the preferred embodiment, the first taper angle is approximately 1°, the second taper angle is approximately 35°, the third taper angle is approximately 31° and the fourth taper angle is approximately 3°. The medial segment of the ring portion is further engageable with a third similarly-shaped portion of the gas cylinder.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
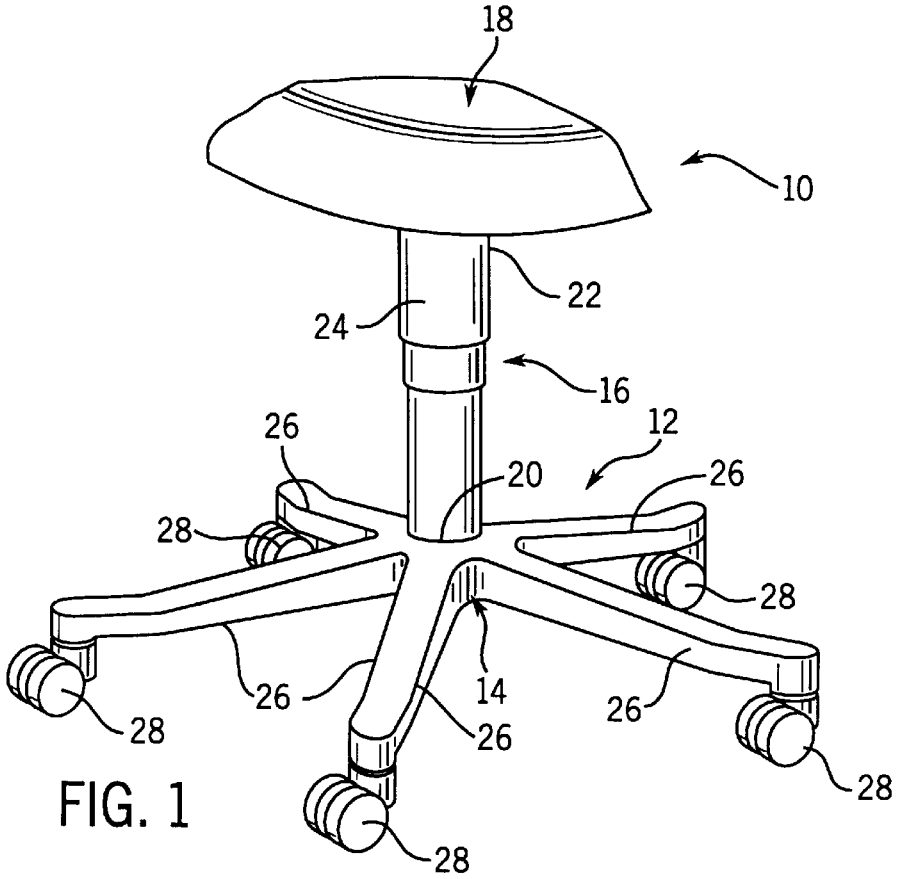
FIG. 1 is a partial isometric view of a swivel-type chair having a seat, a central column and a base including a hub embodying the present invention.
Figure 2:
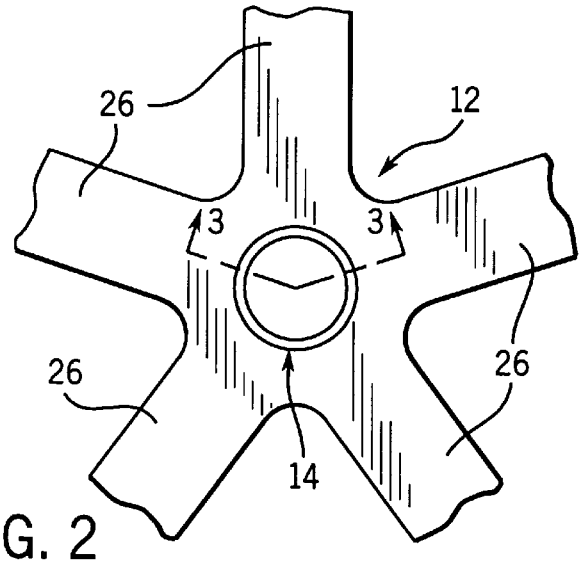
FIG. 2 is a partial top plan view of the base.

Referring now to FIGS. 1 and 2, the reference numeral 10 generally identifies a swivel-type chair having an integral molded base 12 including a central hub 14 embodying the novel features of the present invention. As is well known, the base 12 and hub 14 support a central column 16, preferably in the form of a gas cylinder, and the seat 18. The column 16 extends between a lower end 20 which is slidably inserted into the chair base 12 and a top end 22 which is attached to the seat 18. The column 16 enables the seat 18 to be moved up and down along a central longitudinal axis 24 (FIG. 3), and also permits the seat 18 to swivel or rotate about the axis 24.

Chair base 12 includes a set of five similar arms 26 which are equally spaced around the hub 14 and extend radially outwardly therefrom. A caster 28 may be mounted to a distal end of each leg 26 to provide rolling movement of the chair base 12 over the surface of a floor. The base 12 is preferably formed such that hub 14 and legs 26 are injection molded of a suitable, high strength plastic, but it is also understood that base 12 may be fabricated from metal or other suitable materials as desired. In the preferred embodiment, the column or gas cylinder 16 is typically comprised of metal, but may also be formed of a plastic material.

Figure 3:
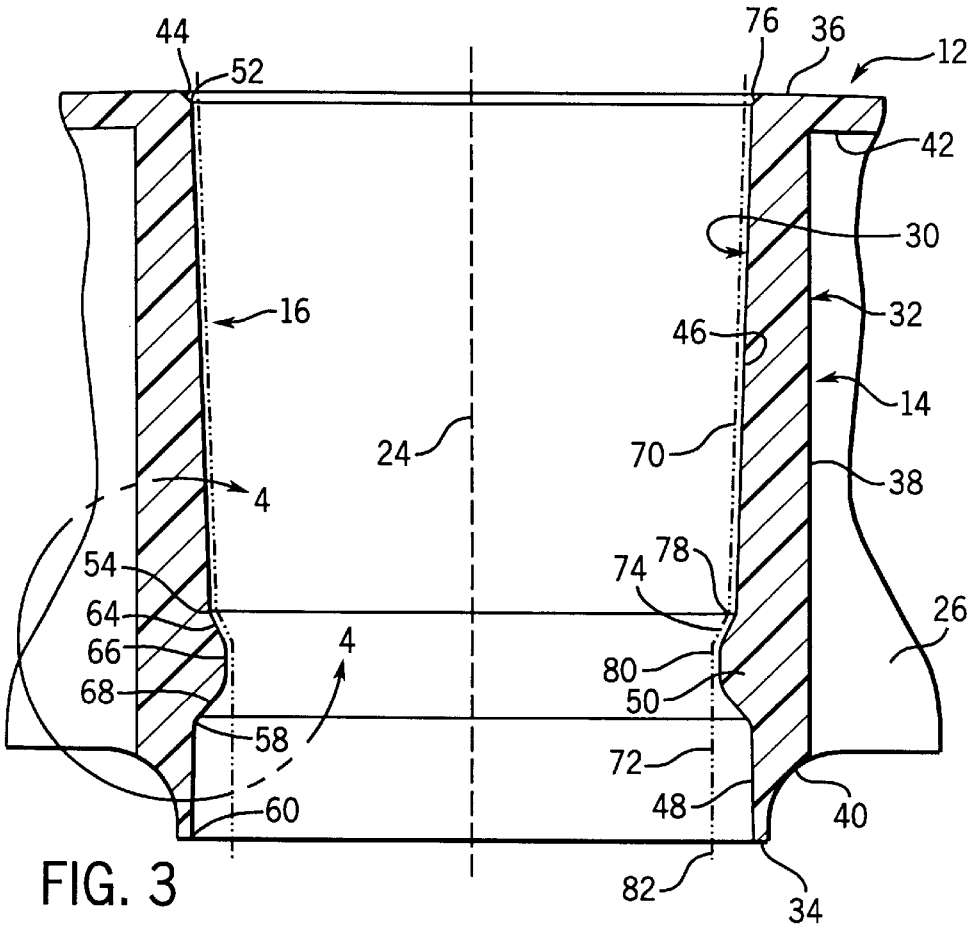
FIG. 3 is a partial cross-sectional view taken on line 3—3 of FIG. 2.
Figure 4:
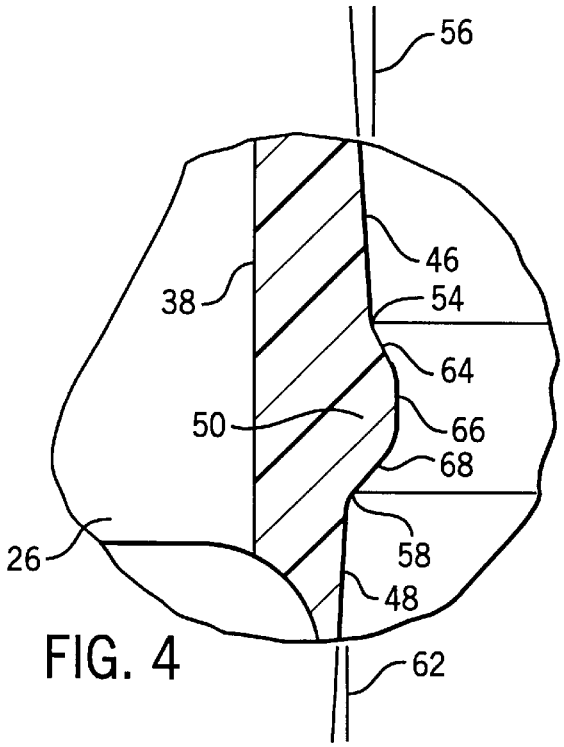
FIG. 4 is an enlarged detail view of a portion of the hub and central column taken along line 4—4 of FIG. 3.

Turning now to FIGS. 3 and 4, the hub 14 includes an interior wall 30 and an exterior wall 32. The interior wall 30 has a variable circular cross section and defines a passage or throughbore passing through the hub 14 along axis 24. The interior wall 30 extends from a bottom surface 34 to an upper surface 36 generally coplanar with the top of arms 26. The exterior wall 32 has a generally cylindrical portion 38 as well as a downwardly and inwardly curved lower portion 40 which adjoins bottom surface 34. The exterior wall 32 is preferably integrally molded to the legs 26, and extends from the bottom surface 34 to an underside 42 of upper surface 36. Although the interior wall 30 is illustrated as being of circular cross section, it should be appreciated that an interior wall 30 of non-circular or polygonal cross section may also be utilized within the scope of the invention.

The interior wall 30 of hub 14 includes an outwardly and upwardly flaring mouth 44 for receiving the column 16 in the hub 14, an upper tapered wall portion 46, a lower tapered wall portion 48 and an inwardly projecting ring portion 50 interconnecting the upper and lower tapered wall portions 46, 48, respectively. The upper tapered wall portion 46 depends from the bottom of the mouth 44 and includes a circular upper edge 52 and a circular lower edge 54. The upper edge 52 is formed with a diameter which is larger than the diameter of the lower edge 54 such that the upper tapered wall portion 46 slopes downwardly and inwardly concentrically at a taper angle of about 1° as measured from a vertical axis 56 (FIG. 4) which is parallel to the longitudinal axis 24 of column 16 and the passage defined by interior wall 30. Upper tapered wall portion 46 defines a primary bearing surface for the column 16 as will be detailed below.

The lower tapered wall portion 48 extends between a circular upper edge 58 and a circular lower edge 60. The upper edge 58 is formed with a diameter which is smaller than the diameter of lower edge 60 such that the lower tapered wall portion 48 slopes downwardly and outwardly concentrically at a taper angle of about 3° relative to a vertical axis 62 (FIG. 4) which is parallel to the longitudinal axis 24. The lower tapered wall portion 48 has a larger cross sectional area than the upper tapered wall portion 46. The lower edge 60 of interior wall 30 adjoins the bottom surface 34 of exterior wall 32.

The ring portion 50 extends between the circular lower edge 54 of the upper tapered wall portion 46 and the circular upper edge 58 of the lower tapered wall portion 48. The ring portion 50 is formed with an upper segment 64, a medial segment 66 and a lower segment 68, and provides at least one bearing surface for engaging a tapered portion of column 16 as will be explained hereafter. Upper segment 64 slopes downwardly and inwardly from circular lower edge 54 at a taper angle of about 35° relative to axis 56, and forms a secondary bearing surface for column 16. Medial segment 66 extends vertically downwardly from the upper segment 64 parallel to axes 56 and 62, and defines the smallest diameter and the innermost extent of the interior wall 30. Medial segment 66 defines a tertiary bearing surface which may also be in engagement with the column 16. Lower segment 68 slopes downwardly and outwardly from medial segment 66 at a taper angle of about 31° relative to axis 56. Defining the downward and inward slope of upper segment 64 as a positive taper, it can be appreciated that the lower segment 68 slopes downwardly and outwardly with an oppositely directed or negative taper. It can be seen that the length of the ring portion 50 is less than the length of the lower taper endwall portion 38, which in turn is less than the length of the upper tapered wall portion 46. Because of these relationships, the upper tapered wall portion 46 is also referred to as the major tapered wall portion, while lower tapered wall portion 48 is designated as the minor tapered wall portion.

Central column or gas cylinder 16, shown in phantom lines in FIG. 3, may be formed of a single piece or multiple pieces, and may include a housing and an appropriate mechanism for selectively varying the length of the column 16 and thereby the height of the seat 18. The lower end of column 16 is formed with a generally conical upper portion 70, a generally cylindrical lower portion 72 and an angular offset conical portion 74. Upper portion 70 is shaped similarly to the major or upper tapered wall portion 46 of hub 14, and extends from a circular first edge 76 to a circular second edge 78. With this structure, a large amount of surface area will be provided between the column 16 and the upper tapered wall portion 46 of hub when the column 16 is completely inserted within the throughbore of hub 14. Lower portion 72 extends between a circular first edge 80 and a circular second edge 82, and is preferably dimensioned to have a diameter smaller than the medial segment 66 of ring portion 50. Thus, when the column 16 is completely inserted into the hub 14, the lower portion 72 will be spaced from the medial segment 66 and lower segment 68 of ring portion 50 as well as the lower tapered wall portion 48. Angularly offset portion 74 extends between circular edges 78 and 80, and is shaped similarly to the upper segment 64 of the ring portion 50 so that the column offset portion 74 will bear firmly on the upper segment 64 at a location adjacent the bottom of legs 26 when the column 16 is fully in place within hub 14.

As the lower portion 72 of column 16 is slidably introduced into hub 14, the edge 82 will pass within and beyond the ring portion 50 of the hub 14. As the column 16 is further positioned, the upper portion 70 of column 16 will begin to contact the upper tapered wall portion 46 of hub interior wall 30 acting as the primary bearing surface so that the upper portion 70 will be eventually press or snug fitted within the upper tapered wall portion 46 as the column 16 travels further downwardly. With this further travel, the angularly offset portion 74 of column 16 will engage the secondary bearing surface formed by the sloping upper segment 64 of the ring portion 50. The engagement of the column offset portion 74 with the sloping upper segment 64 of ring portion 50 will prevent the column 16 from creeping or moving downwardly through the hub 14 during use when various loads are applied to the seat 18 of the chair 10. Once contact has been made between the offset portion 74 and upper segment 64, the column 16 will remain firmly attached to the hub 14 by means of the press fit between column upper portion 70 and primary bearing surface 46 so that lateral deflection or wobbling of the column 16 relative to the hub 14 will not occur. In the preferred embodiment, the lower portion 72 of the column 16 is shown spaced from the medial segment 66 and the lower segment 68 of ring portion 50 as well as the lower tapered wall portion 48 of hub 14 so that the medial segment 66, lower segment 68 and lower tapered wall portion 48 are all non-bearing surfaces. However, it should be appreciated that if further stabilization of the column is desired, the column 16 can be designed so that the column lower portion 72 may engage the ring portion medial segment 66 which then serves as the tertiary bearing surface on the hub 14.

It should be appreciated that the present invention provides an improved, sleeveless chair base hub 14 in which the upper tapered wall portion 46, at least the upper segment 64 of ring portion 50 and possibly the medial portion 66 thereof ensure a positive seating of the column 16 within the hub 14 so that both tilting and creeping of the column 16 are effectively prevented. It should likewise be appreciated that the present invention provides a chair base hub 14 having non-bearing surfaces 48 and 68 which are formed with oppositely directed or negative tapers relative to bearing surfaces 46 and 64. It has been found that there is no need to add extra material to these non-bearing surfaces to absorb the loads imposed upon the chair 10 so that there is a cost savings factor in material used without a sacrifice in performance. Additionally, the formation of non-bearing surfaces 48 and 68 enables easier and more cost effective methods of molding and the holding of more reasonable manufacturing tolerances while constantly maintaining a snug fit between the column 16 and hub 14.

Various alternatives and embodiments are contemplated as being within the scope of the following claims particularly pointing out and distinctly claiming the subject matter regarded as the invention.

We claim:

1. A base for a chair, comprising:

a set of arms; and a central hub from which the arms extend, wherein the hub is adapted for mounting and maintaining therein a column for joining the base with a seat of the chair;

wherein the hub is formed with a passage extending along a longitudinal axis and defining a first wall portion tapered downwardly and inwardly relative to the longitudinal axis, and a second wall portion tapered downwardly and outwardly relative to the longitudinal axis, wherein a ring area is interposed between the first and second wall portions, and wherein the cross-sectional area of the passage defined by the second wall portion adjacent the ring area is larger than the cross-sectional area of the passage defined by the first wall portion adjacent the ring area, wherein the passage is adapted to receive the column and the first and second wall portions are operable to prevent the column from moving laterally and downwardly relative to the base.

2. The chair base of claim 1, wherein the passage farther defines a ring portion projecting inwardly relative to the longitudinal axis and interconnecting the first wall portion and the second wall portion.

3. The chair base of claim 2, wherein the ring portion has an upper segment sloping downwardly and inwardly from the first wall portion, a medial segment extending vertically from the upper segment, and a lower segment sloping downwardly and outwardly form the medial segment, wherein the column includes an annular offset portion adapted to engage the upper segment of the ring portion.

4. The chair base of claim 3, wherein the ring portion of the hub is located adjacent a bottom end of the arms.

5. The chair base of claim 1, wherein the first wall portion has a length which is longer than the length of the second wall portion.

6. A base for a chair, comprising:

a set of arms; and a central hub from which the arms extend, wherein the hub is adapted for mounting and maintaining therein a column for joining the base with a seat of the chair;

wherein the hub is formed with a passage extending along a longitudinal axis and defining a first wall portion tapered downwardly and inwardly relative to the longitudinal axis, a second wall portion tapered downwardly and outwardly relative to the longitudinal axis, and a ring portion projecting inwardly relative to the longitudinal axis and interconnecting the first wall portion and the second wall portion, wherein the second wall portion has a length which is longer than the length of the ring portion, and wherein the passage is adapted to receive the column and the first and second wall portions are operable to prevent the column from moving laterally and downwardly relative to the base.

7. A chair support assembly, comprising:

a base including a central hub; and a column engageable with the base for joining the base with a seat of the chair;

wherein the hub includes a passage extending along a longitudinal axis and defining a primary bearing surface in the form of a major tapered wall portion sloping downwardly and inwardly at a first taper angle relative to the longitudinal axis, and a ring portion having at least a secondary bearing surface sloping downwardly and inwardly from the major tapered wall portion at a second taper angle greater than the first taper angle;

wherein the column is configured to engage the major tapered wall portion to prevent the column from wobbling, and defines a shoulder configured to engage the secondary bearing surface to prevent the column from creeping through the base.

8. The chair support assembly of claim 7, wherein the ring portion includes a tertiary bearing surface extending substantially vertically downwardly from the secondary bearing surface for further stabilizing the column against wobbling, and a non-bearing surface extending downwardly and outwardly from the tertiary bearing surface.

9. A chair support assembly, comprising:

a base including a central hub; and a column for joining the base with a seat of the chair;

wherein the hub includes a passage extending along a longitudinal axis and defining a primary bearing surface in the form of a major tapered wall portion sloping downwardly and inwardly at a first taper angle relative to the longitudinal axis, and a ring portion having at least a secondary bearing surface sloping downwardly and inwardly from the major tapered wall portion at a second taper angle greater than the first taper angle, wherein the major tapered wall portion prevents the column from wobbling, and the secondary bearing surface prevents the column from creeping through the base, wherein the ring portion includes a tertiary bearing surface extending substantially vertically downwardly from the secondary bearing surface for further stabilizing the column against wobbling, and a non-bearing surface extending downwardly and outwardly from the tertiary bearing surface, wherein the passage further includes a minor tapered wall portion sloping downwardly and outwardly from the non-bearing surface of the ring portion.

10. The improvement of claim 9, wherein the column includes an upper portion shaped similarly to the major tapered wall portion of the hub, an angularly offset portion shaped similarly to the secondary bearing surface on the ring portion, and a lower, generally cylindrical portion formed with a diameter less than the diameter of the upper portion of the column and spaced from the non-bearing surface and the minor tapered wall portion.

11. A chair base adapted to mount a support member for supporting a seat associated with a chair, comprising:

a hub;

a passage formed in the hub and adapted to receive the support member, wherein the passage defines an interior wall comprising:

an upper portion sloping downwardly and inwardly at a first taper angle relative to a longitudinal axis of the passage;

a ring portion having an upper segment sloping downwardly and inwardly from the upper portion at a second taper angle greater than the first taper angle, a medial segment extending from the upper segment, and a lower segment sloping downwardly and outwardly from the medial segment at a third taper angle less than the second taper angle but greater than the first taper angle; and a lower portion sloping downwardly and outwardly from the lower segment of the ring portion at a fourth taper angle relative to the longitudinal axis of the passage and slightly greater than the first taper angle;

wherein the upper portion is adapted to cooperate with a first portion of the support member to prevent wobbling of the support member relative to the base, and the upper segment of the ring portion is adapted to engage a second portion of the support member to preclude longitudinal movement of the support member relative to the base.

12. The chair base of claim 11, wherein the first taper angle is approximately 1°.

13. The chair base of claim 11, wherein the second taper angle is approximately 35°.

14. The chair base of claim 11, wherein the third taper angle is approximately 31°.

15. The chair base of claim 11, wherein the fourth taper angle is approximately 3°.

16. The chair base of claim 11, wherein the medial segment of the ring portion is adapted to engage a third portion of the support member.

* * * * *